United States Patent [19]

Hansell, III

[11] 4,412,092

[45] Oct. 25, 1983

[54] MULTICONDUCTOR COAXIAL CABLE ASSEMBLY AND METHOD OF FABRICATION

[75] Inventor: George A. Hansell, III, Newark, Del.

[73] Assignee: W. L. Gore & Associates, Inc., Newark, Del.

[21] Appl. No.: 295,822

[22] Filed: Aug. 24, 1981

[51] Int. Cl.[3] ..... H01B 11/20; H01B 13/22

[52] U.S. Cl. ..... 174/36; 156/52; 174/103; 174/117 F

[58] Field of Search ..... 174/36, 103, 115, 117 F, 174/117 FF, 117 M; 156/52

[56] References Cited

U.S. PATENT DOCUMENTS

| | | | |
|---|---|---|---|
| 2,043,044 | 6/1936 | Knoderer | 174/104 |
| 2,286,827 | 6/1942 | Morrison | 174/103 |
| 3,673,315 | 6/1972 | Lasley | 174/115 X |
| 3,775,552 | 11/1973 | Schumacher | 174/117 F X |
| 4,185,162 | 1/1980 | Bogese | 174/115 |
| 4,218,581 | 8/1980 | Suzuki | 174/36 X |
| 4,234,759 | 11/1980 | Harlow | 174/117 F X |
| 4,281,212 | 7/1981 | Bogese | 174/117 F |
| 4,314,737 | 2/1982 | Bogese et al. | 174/117 F |

FOREIGN PATENT DOCUMENTS

| | | | |
|---|---|---|---|
| 18535 | 7/1904 | Austria | 174/36 |
| 2644252 | 3/1978 | Fed. Rep. of Germany | 174/117 F |
| 1447361 | 6/1966 | France | 174/115 |
| 134160 | 2/1979 | German Democratic Rep. | 174/117 F |
| 53-37880 | 4/1978 | Japan | 174/117 F |

*Primary Examiner*—Laramie E. Askin
*Assistant Examiner*—Morris H. Nimmo
*Attorney, Agent, or Firm*—Finnegan, Henderson, Farabow, Garrett & Dunner

[57] ABSTRACT

A flat multiconductor cable assembly having a plurality of individually shielded coaxial cable elements and one or more ground wires positioned in transversely spaced, side-by-side relation with a conductive screen or web interwoven in the transverse direction to physically contact and electrically interconnect the shields, the screen or web extending intermittently in the longitudinal direction in the spaces between adjacent cable elements and ground wires. A cable jacket is provided with opposing jacket sides being bonded together in the portion of the longitudinal spaces not occupied by the screen or web.

20 Claims, 4 Drawing Figures

Z
X
Y

MULTICONDUCTOR COAXIAL CABLE ASSEMBLY AND METHOD OF FABRICATION

BACKGROUND OF THE INVENTION

1. Field of the Invention

This invention relates to coaxially shielded cables which are suitable for high fidelity electrical signal transmission, and a method of making same.

2. Description of the Prior Art

Coaxially shielded cables are well known as the highest fidelity signal wiring for digital signals and analog signals through the microwave range. Their usefulness has been limited by cumbersome and time consuming termination methods. The need for coaxial cables which can be efficiently terminated has been recognized and addressed by previous inventions. U.S. Pat. No. 3,775,552 discloses a specific cable design with multiple coaxially shielded conductors in a flat cable which permits mass termination. That invention requires individual termination of a shield or ground wire for each signal wire, which requirement limits cable and connector density through imposition of a mechanical requirement which is often not an electrical requirement. U.S. Pat. No. 4,234,759 discloses a flat multiconductor coaxial cable assembly having a single ground wire for every pair of coaxial cable elements permitting somewhat higher signal carrying densities (i.e., number of signal conductors per unit transverse width).

The purpose of the present invention is to provide a flat cable with multiple coaxially shielded conductors wherein the shields are grounded by a single or a relatively small number of ground wires compared to the number of signal wires. Higher signal carrying densities in cable and connector are thus achieved.

SUMMARY OF THE INVENTION

In accordance with the purpose of the invention, as embodied and broadly described herein, the flat multiconductor cable assembly of unlimited length of the present invention comprises a plurality of signal conductors positioned in longitudinally parallel and transversely co-planar relation, the signal conductors being electrically insulated from one another and arranged in clusters of one or more, each of the clusters being individually and coaxially surrounded by an electrically conductive shield, the individually shielded clusters being transversely spaced from one another; means for grounding the shields of the clusters; and a conductive element for electrically interconnecting the shields of the shielded clusters with the grounding means in the transverse direction, the transverse conductive element being interwoven among the transversely spaced clusters and extending intermittently in the longitudinal direction in the spaces between the clusters.

Preferably, the grounding means includes at least one uninsulated conductor extending in the longitudinal direction parallel to and transversely spaced from the shielded clusters, and is interwoven along with, and thus electrically interconnected with, the transversely connected clusters by the transverse conductive element.

It is also preferred that the shielded clusters together with the interwoven transverse conductive element and the grounding means are encapsulated in an insulating and protective covering, the covering being bonded to itself in the portions of the spaces between adjacent spaced clusters not occupied by the transverse conductive element.

Also in accordance with the purpose of the present invention, the method of the present invention for fabricating a flat multiconductor cable assembly of unlimited length having at least one ground wire conductor wherein a plurality of insulated signal conductors are positioned in longitudinally parallel and transversely co-planar relation with the ground wire conductor, and wherein the signal conductors are arranged in clusters of one or more, and the clusters are coaxially surrounded by an electrically conductive shield, the shielded clusters being physically spaced from, but electrically interconnected with one another and the ground wire conductor in the transverse direction, comprises (a) dividing sources of the unlimited length shielded clusters into two groups positioned proximate a pair of pinch rollers; (b) continuously feeding the shielded clusters into the bite of the pinch rollers, the shielded clusters from one of the groups being interspersed with the shielded clusters from the other of the two groups across the transverse width of the bite, and the shielded clusters from one group being fed from one side of a plane passing through the bite of the pinch rollers and the shielded clusters from the other group being fed from the other side of the plane; (c) concurrently feeding at least one continuous uninsulated ground wire conductor of unlimited length into the bite of the pinch rollers parallel with, and transversely spaced from, the clusters; and (d) concurrently feeding an uninsulated transverse conductive element of unlimited longitudinal length into the bite of the rollers along the plane and between the shielded clusters being fed from the two source groups, the transverse conductive element transversely spanning and electrically interconnecting the shields of the clusters and the uninsulated ground wire conductor, the transverse conductive element having sufficient flexibility in the transverse direction to conform to a serpentine transverse conductor element path shape wherein the transverse conductive element passes alternately to one side, between, and to the other side of the interspersed clusters with respect to the plane, the transverse conductive element extending intermittently in the spaces between interspersed clusters along the entire longitudinal length of the cable assembly.

Preferably, the method includes the further step of (e) encapsulating the shielded clusters, ground wire conductor, and interwoven transverse conductive element in an insulating and protective covering, the encapsulating step including the step of bonding the cover to itself through the portions of the spaces between adjacent clusters not occupied by the transverse conductor element.

It may be further preferred that step (c) includes the steps of feeding at least two uninsulated ground wire conductors into the bite of the pinch rollers, each of the uninsulated ground wire conductors being positioned outside of and spaced from the outermost cluster on the respective transverse edges of the cable assembly, and wherein step (d) includes the substep of preforming the transverse conductor element in the form of a web by continuously spirally wrapping at least one uninsulated elongated conductor between the two uninsulated ground wire conductors prior to feeding the two uninsulated ground wire conductors and the between-suspended web to the bite of the pinch rollers.

Reference will now be made in detail to the present preferred embodiment of the invention, an example which illustrated in the accompanying drawings.

The accompanying drawings, which are incorporated and constitutes a part of this specification, illustrate one embodiment of the invention and, together with the description, serve to explain the principles of the invention.

DESCRIPTION OF THE PREFERRED EMBODIMENT

Figures 1, 2:
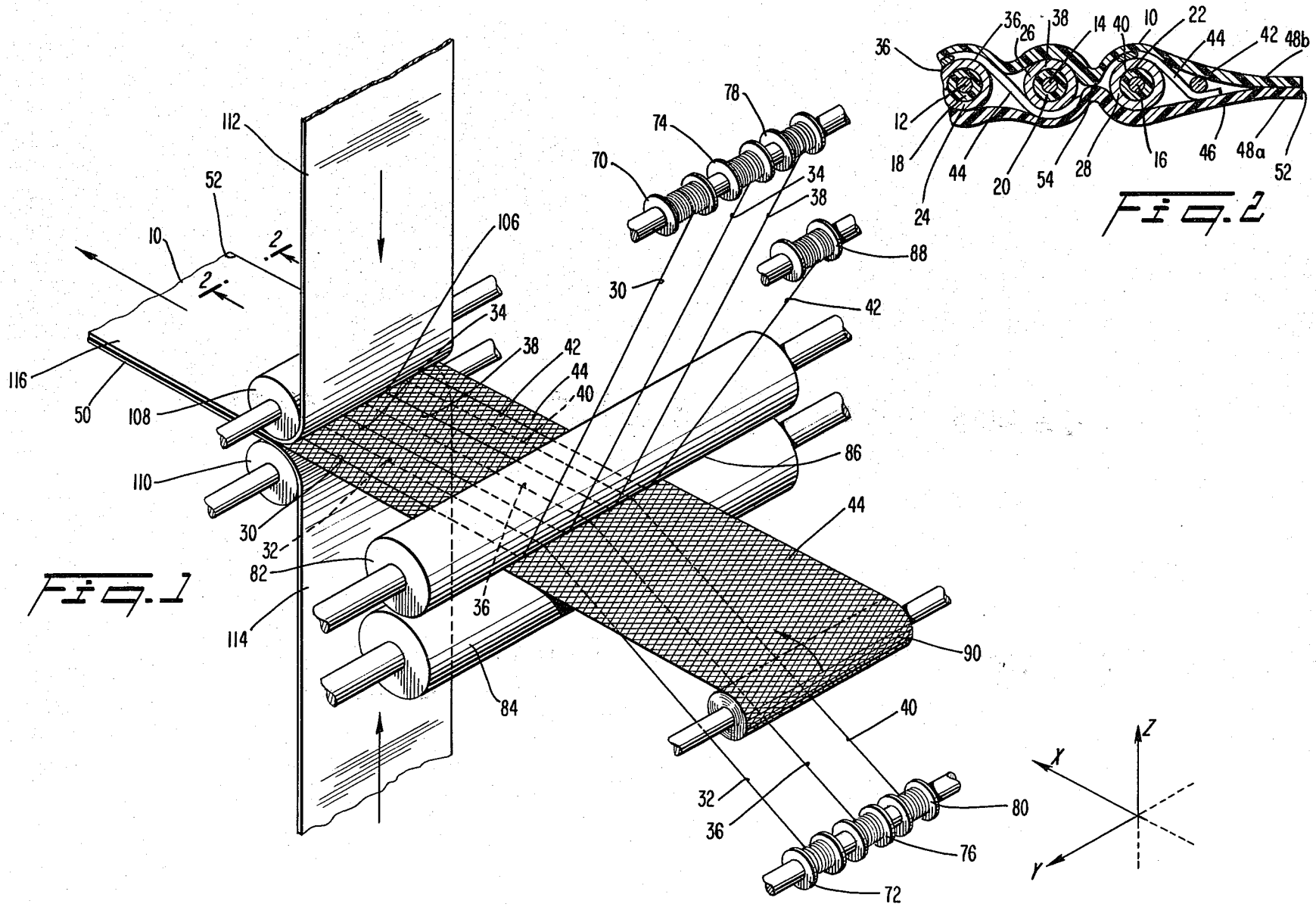
FIG. 1 is a perspective, schematic view of apparatus used to carry out the process of making the flat multiconductor cable assembly of the present invention.
FIG. 2 is a cross-sectional view of a portion of the completed cable assembly of the present invention manufactured by the apparatus depicted in FIG. 1, taken at the line 2—2.

With respect to FIGS. 1 and 2 of the drawings, there is shown a flat multiconductor cable made in accordance with the present invention and designated generally as 10. Cable 10 is especially useful in high fidelity signal transmission applications wherein ease of termination is required and especially where a relatively high signal density carrier is required, in terms of the cross-sectional area of the cable. However, cable 10 is to be viewed only as representative of the cables made in accordance with this invention, as a multitude of different flat cable configurations are possible, as will be immediately understood as a consequence of the following disclosure.

In accordance with the present invention, a plurality of signal conductors of unlimited length are positioned in longitudinally parallel and transversely co-planar relation, with the signal conductors being electrically insulated from one another and arranged in clusters of one or more, each of the clusters further being individually and co-axially surrounded by an electrically conductive shield, with the individually shielded clusters being transversely spaced from one another. As embodied in the cable construction 10 shown in FIGS. 1 and 2, cable 10 includes signal conductors 12, 14, and 16 with surrounding insulation layers 18, 20 and 22 respectively. Conductors 12, 14 and 16 are shown as single strand round wire conductors, but multiple strands and/or other conductor cross section geometries can be used, such as flat metal or metalized polymer strips.

Conventional insulation materials can be employed for the insulation layers 18, 20 and 22 with a preferred material being expanded polytetrafluoroethyelene (PTFE) marketed under the trademark GORETEX by W. L. Gore and Associates, Inc.

As further embodied herein, and with particular reference to FIG. 2, the insulated conductor elements including elements 12, 14 and 16 are each surrounded by electrically conductive shields, such as shields 24, 26 and 28 respectively. The shield material is conventional and can be metal-foil or braided metal strands or even metalized polymer film. As is readily apparent, the function of the shields 24, 26 and 28 is to prevent extraneous inductive or compacitive coupling between adjacent signal conductors or outside sources, thereby eliminating cross-talk, and enabling close packing of the signal conductors. The individual shields also assure consistent signal transmission properties and thus minimize signal loss.

As further embodied herein, cable 10 of the present invention which is shown being fabricated in FIG. 1 (to be discussed infra) has a total of six individually shielded clusters 30, 32, 34, 36, 38 and 40, with the individual clusters being transversely spaced from one another all along the longitudinal length of the cable 10. Thus, in cable 10 the six signal conductors, including signal conductors elements 12, 14 and 16, are arranged in clusters having only one signal conductor per cluster. Certain other applications may dictate a different grouping of signal conductors, such as two or more, in each shielded cluster (not shown), and the scope of the present invention is intended to cover such multiconductor cables as well.

In accordance with the present invention, there is further provided means for grounding the shields of the individually shielded clusters, including a ground conductor. As embodied herein, an uninsulated ground wire 42 is positioned in cable 10 longitudinally parallel to the shielded clusters 30 . . . 40 throughout the entire length of the cable 10. Ground wire 42 is shown positioned outside the outermost shielded cluster at one transverse cable edge, namely cluster 40 (see FIG. 2), but other locations are possible. Moreover, a plurality of ground wires 42 may be used, but more than one ground wire necessarily detracts from the high signal wire density of the cable because, in certain constructions, the ground wire may occupy the position of a shielded cluster. Preferably, the ground wire 42 is transversely spaced from adjacent shielded clusters, such as cluster 40, for reasons which will become apparent from further discussions.

Further in accordance with the present invention, the grounding means of the flat multiconductor cable assembly includes a conductive element for electrically interconnecting the shields of the shielded clusters with the ground conductor in the transverse direction, with the transverse conductive element being interwoven among the transversely spaced clusters and extending intermittently in the longitudinal direction in the spaces between the clusters. As embodied herein, cable 10 includes an electrically conducting screen 44 which is interwoven among clusters 30 . . . 40 and ground wire 42, passing alternately below some of the clusters and alternatively above others, with respect to the plane defined by the signal conductors, but physically contacting the respective outer electrical shields of the shielded clusters 30 . . . 40 to establish the required electrical connection. Screen 44 can be of a conventional type made from two sets of parallel strands woven or bonded together with one set being angularly offset from the other, or screen 44 can be made from a continuous conductive sheet and then perforated. It is important, especially when screen 4 is made from a perforated foil, that the void fraction (ratio of area of the perforation to the total screen area) be as large as possible for reasons that will become apparent from the succeeding discussion.

The individual strands of the screen 44 can be seen in FIG. 2 where they are schematically depicted. The strands appear discontinuous only because the screen 42 is oriented with the bias direction in the longitudinal direction of cable 10. It is understood that the individual conductor strands of screen 44 completely span the transverse direction of cable 10. For instance, although no strand of the transverse conductor screen 44 is shown connecting shield 26 with shield 28 at the cross section shown in FIG. 2, such a connecting strand would appear in a section taken at another location along the longitudinal axis, at which other location no strand would be shown between shield 24 and shield 26 for the particular screen 44 orientation depicted in the cable 10 embodiment. The use of screen material oriented with strands substantial perpendicular, or at any other angle, to the longitudinal axis is also contemplated by the present invention. For the former perpendicular orientation, a cross section such as shown in FIG. 2 could, of course, show a screen strand completely spanning the cable 10 without apparent discontinuities or, at another location, show no transverse strand. The mesh size of screen 44 or the longitudinal distance between successive perforations will, in general, be dictated by the electrical requirements of the cable.

Figure 4:
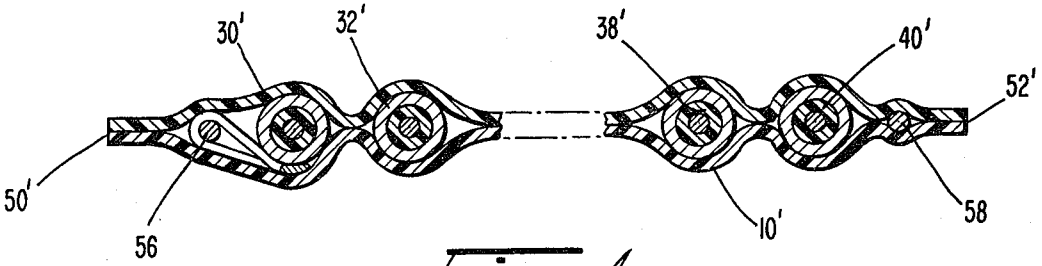
FIG. 4 is a broken cross section of a cable assembly that would result if the apparatus pictured schematically in FIG. 3 were used with the apparatus depicted in FIG. 1.

In an alternate cable construction made according to the present invention, and designated by 10' in FIG. 4, a web 60 (best seen in FIG. 3) made up of a single uninsulated conductor element 62 is substituted for the screen 44 in the means for transversely electrically interconnecting the shielded clusters and the grounding means. In this alternate construction (where components similar to those disclosed with respect to the cable construction shown in FIGS. 1 and 2 are designated by the same reference numerals but with primes) two uninsulated ground wires 56, 58 are provided positioned outside all the shielded clusters to be grounded, namely shielded clusters 30', 32' . . . 38' and 40' in longitudinally parallel but transversely spaced relationship therewith. Due to the manner in which the cable 10' is fabricated (to be discussed infra) the uninsulated conductor element 62 is spirally wound between the ground wires 56 and 58 and thereby maintains firms physical, and therefore electrical, contact with ground wires 56, 58 as well as physically contacting the electrical shields of the shielded clusters around which web 60 is interwoven.

The term "interwoven" as used herein is used not only to designate a true weave wherein the longitudinal elements are physically captured by the transverse elements, and wherein the resulting structure is self-supporting, but also the configuration shown in FIGS. 1-4 wherein the transverse element (screen 44—FIGS. 1 and 2; web 60—FIGS. 3 and 4) follows the same serpentine path between the longitudinal elements (shielded clusters 30 . . . 40 and ground wire 42—FIGS. 1 and 2; shielded clusters 30' . . . 40' and ground wires 56-58—FIGS. 3 and 4) at every point along the longitudinal cable axis. For certain applications where a self-supporting cable preform (that is, a cable without a insulating and protective jacket covering) is required, a true weave may be desireable. However, the usual commercial use of an insulating and protective jacket to cover the multiconductor cable preform allows the option of using the non-interlocking weave shown in FIGS. 1-4 with possible cost savings in view of the expense of weaving machines.

It is further preferred that the flat multiconductor cables of the present invention including the cables 10 and 10' shown in the drawings be encapsulated in an insulating and protective covering or "jacketed" as that term is conventionally used in the electrical cable art.

As embodied herein, and with reference to FIGS. 1 and 2, cable 10 has a jacket 46 formed from a pair of sheets **48*a*, 48*b* of PVC or other conventional cable jacketing material, one sheet disposed on each side of the plane defined by the signal conductors 12, 14 and 16 and physically contacting the shielded clusters 30 . . . 40, ground wire 42 and screen 44 sandwiched therebetween. Sheets 48*a* and 48*b* are bound together at the cable transverse edges 50, 52 and may also be bound to one or more of the shields including shields 24, 26, and 28, ground wire 42, and the transverse conductive screen 44**.

Importantly, sheets **48*a*, 48*b* are bound together between the adjacent clusters and ground wire in the portions of the longitudinal spaces not occupied by screen 44, such as is depicted at position 54 shown in FIG. 2. This intermittent but extensive binding between opposing sides of jacket 46** in each longitudinal space between the shielded clusters and ground wires provides cable integrity and the maintenance of cluster-cluster spacing needed for accurate cable termination especially using automatic terminating apparatus.

In accordance with the present invention, the method for fabricating the flat multiconductor cable assemblies of unlimited length, described previously, includes the step of dividing sources of the unlimited length shielded clusters into two groups and positioning them proximate a pair of pinch rollers. As embodied herein, and with particular reference to FIG. 1, sources 70, 72, 74, 76, 78 and 80 are shown for the shielded clusters 30, 32, 34, 36, 38 and 40 respectively. The individual sources depicted comprise spools with associated mounting and take-off apparatus and are positioned near cooperating pinch rollers 82, 84 having bite 86. Sources 70, 74 and 78 are grouped and located above the XY plane which passes through bite 86, while the remaining three sources 72, 76 and 80 are below the XY plane.

Further in accordance with the present invention, the method includes the additional step of continuously feeding the shielded clusters into the bite of the pinch rollers with the shielded clusters from one of the groups being interspersed with the shielded clusters from the other of the group across the transverse width of the bite. As embodied herein, shielded clusters 30, 34 and 38 from one group are fed to bite 86 from one side of the XY plane while the shielded clusters 32, 36 and 40 are fed to bite 86 from the other side of the XY plane. Preferably, and as shown in FIG. 1, the shielded clusters fed from the two groups strictly alternate across the transverse width of the bite, with a shielded conductor from one group being adjacent a shielded conductor from the other group in alternating fashion.

Further in accordance with the present invention, the method comprises the additional step of concurrently feeding at least one continuous uninsulated ground wire conductor of unlimited length into the bite of the pinch rollers in parallel with, and preferably transversely spaced from, said clusters. As embodied herein, ground wire 42 is shown emmanating from ground wire source 88 and being fed to bite 86 of rollers 82, 84 adjacent and spaced from shielded cluster 40. Preferably, the ground wire 42 is fed from one or the other side of the XY plane to alternate with the adjacent shielded cluster. In the embodiment shown in FIG. 1, the ground wire 42 is fed to bite 86 from the side of the XY plane opposite the side from which shielded cluster 40 is fed.

Further in accordance with the present invention, the method includes the step of concurrently feeding an uninsulated transverse conductive element of unlimited longitudinal length into the bite of the rollers along the dividing plane and between the shielded clusters being fed from the two source groups. As embodied herein, and as seen in FIG. 1, screen 44 is shown being fed to the bite 86 of pinch rollers 82 and 84 from source 90 along the XY plane. The screen conductor 44 spans both the shielded clusters and the uninsulated ground wire conductor in the transverse direction and has sufficient transverse flexibility to conform to the serpentine path shape wherein the screen 44 passes alternately to one side, between, and then to the other side of the adjacent shielded clusters with respect to the XY plane. Appropriately tensioning the sources of the shielded clusters relative to the source 90 of screen 44 will ensure that the screen 44 conforms to the shape of the path between the adjacent shielded clusters rather than vice versa, thereby ensuring a multiconductor cable assembly having the signal conductors such as conductors 12, 14 and 16 aligned in transversely co-planar relation.

For the alternate cable construction 10' as shown in FIG. 4 which utilizes a web 60 formed from a single uninsulated conductor 62, the step of concurrently feeding at least one continuous uninsulated ground wire conductor into the bite of the pinch rollers preferably includes the step of feeding at least two uninsulated ground wire conductors into the bite of the pinch rollers, each of the uninsulated ground wire conductors being positioned outside of and spaced from the outermost cluster at the respective transverse edges of the cable assembly. Furthermore, the step of concurrently feeding an uninsulated transverse conductor element into the bite of the pinch rollers preferably includes the substep of preforming the transverse conductor element in the form of a web by spirally wrapping at least one uninsulated elongated conductor between the two ground wire conductors prior to feeding the ground wire conductors and the between-suspended web to the bite of the pinch rollers.

Figure 3:
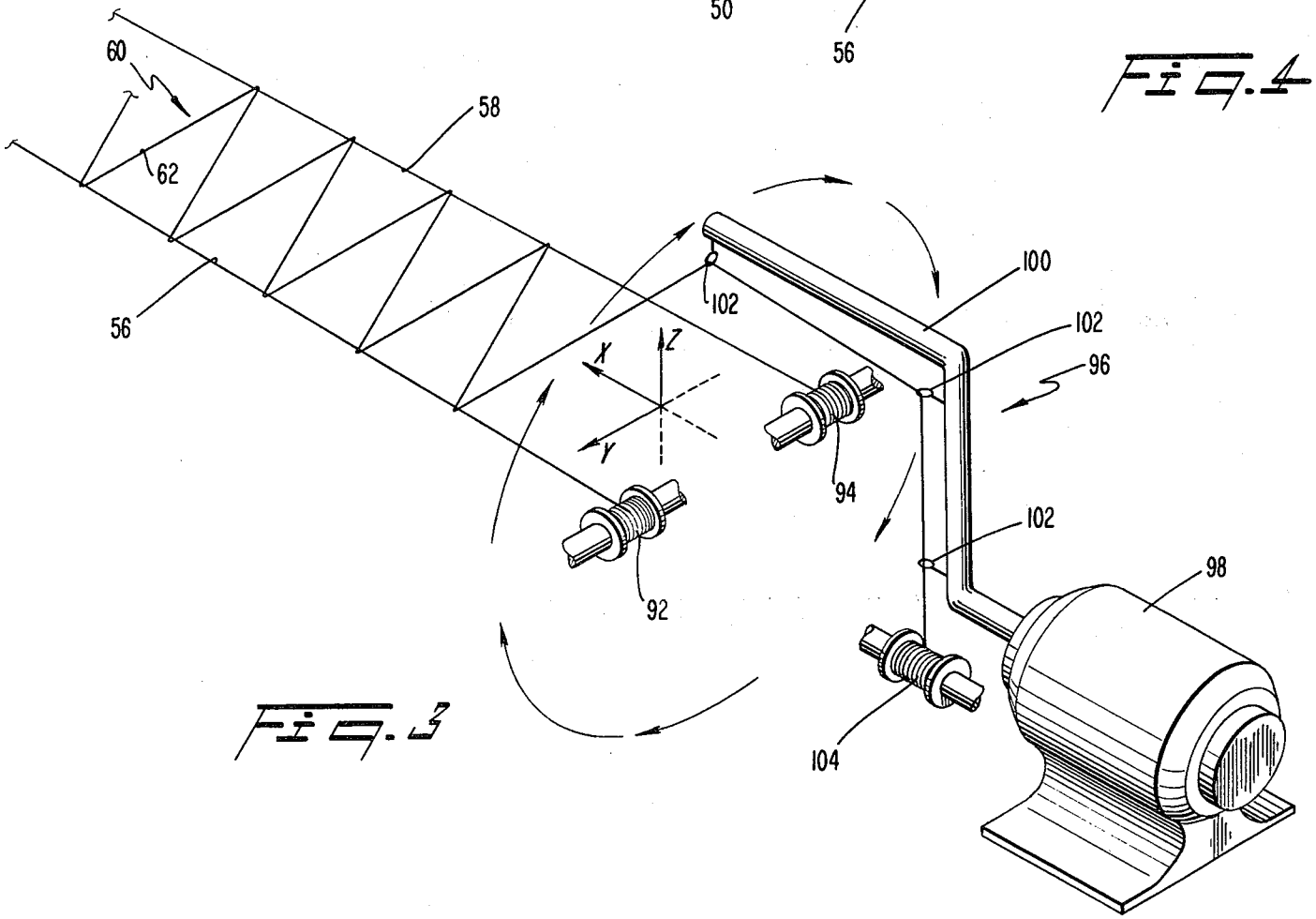
FIG. 3 is a schematic of a portion of apparatus used for carrying out a variation of the process shown in FIG. 1.

As embodied herein, with particular reference to FIG. 3, ground wires 56 and 58 are shown being fed along the XY plane from ground wire sources 92 and 94 respectively. A web 60 is shown continuously being produced by apparatus designated generally 96, the web consisting of a single conductor strand 62 spirally wrapped around the parallel ground wire conductors 56, 58. Apparatus 96 includes a motor 98 with the spinning arm 100 having wire guides 102 through which conductor 62 passes, and being fed from conductor source 104. The circular motion of the tip of arm 100 is shown schematically with arrows in FIG. 3.

Ground wires 56 and 58 and the between-suspended web 60 are shown lying in the XY plane in FIG. 3 to underscore the fact that it is intended as a replacement for the screen 44 transverse conductor element shown being fed to the bite 86 in FIG. 1. In the fabrication of cable construction 10' as shown in FIG. 4, it is understood that the ground wires 56, 58 supporting web 60 will, in general, serve the same function and therefore take the place of the single ground wire 42 using the construction of the cable assembly 10 pictured in FIG. 4.

While web 60 also could be preformed between a single ground wire and an outer-most cluster or between the two outer-most clusters for cables having an interiorally located signal ground wire (all not shown), the relative fraility of the shielded clusters compared to the ground wires makes these constructions not as preferable, although they are considered within the scope of the present invention.

Further in accordance with the present invention, the method of fabricating a flat multiconductor cable assembly preferably includes the additional step of encapsulating the shielded clusters, ground wire conductor, and interwoven transverse conductive element in an insulating and protective covering, with the encapsulating step including the step of binding the cover to itself through the portions of the spaces between adjacent clusters not occupied by the transverse conductor element. As embodied herein, with reference to FIG. 1, the multiconductor cable preform including the shielded clusters 30, 32, 34, 36, 38 and 40 and the ground wire 42 together with the interwoven screen 44 is shown emmanating from the bite 86 of pinch rollers 82, 84 and subsequently being fed to the bite 106 of another pair of pinch rollers 108, 110. Also fed to bite 106 are a pair of PVC sheets 112 and 114 from respective sources (not shown). Through the action of pinch rollers 108, 110 the PVC sheets which are applied on either side of the cable preform contact the elements of the cable preform and most importantly are made to bind to one another not only at the cable transverse edges 50, 52, but also in the spaces between adjacent shielded clusters 30, 32 etc. and ground wire 42 not taken up by the strands of screen 44. Applying an insulated and protective jacket, which is designated 116 on the finished cable emmanating from the bite 106 of pinch rollers 108, 110, such that binding between the opposing portions of the jacket occurs, is within the capability of one of ordinary skill in the art, and can be accomplished by a variety of known processes such as by heating the PVC sheets 112, 114 prior to feeding them to the bite 106 and/or by using heated pinch rollers, or other binding techniques may be used. Similarly, the scope of the present invention is not restricted to the use of PVC as the jacket material and the selection of other insulating and protective covering materials is well within the skill of one working in the multiconductor cable fabrication art.

It will be apparent to those skilled in the art that various modifications and variations could be made in the flat multiconductor cable assemblies of the present invention without departing from the scope or spirit of the invention.

What is claimed is:

1. A flat multiconductor cable assembly of unlimited length comprising:

a plurality of signal conductors positioned in longitudinally parallel and transversely co-planar relation, said signal conductors being electrically insulated from one another and arranged in clusters of one or more, each of said clusters being individually and coaxially surrounding by an electrically conductive shield, the individually shielded clusters being transversely spaced from one another; and means for grounding the shields of said clusters, including a ground conductor, and a transverse conductive element for electrically interconnecting the shields of said shielded clusters with said ground conductor in the transverse direction, said transverse conductive element being interwoven among the transversely spaced clusters and extending intermittently in the longitudinal direction in the spaces between said clusters, whereby said individually shielded clusters are arbitrarily geometrically arranged on said transverse conductive element.

2. Assembly as in claim 1 wherein said ground conductor includes at least one uninsulated conductor extending in the longitudinal direction parallel to said shielded clusters.

3. Assembly as in claim 2 wherein said uninsulated conductor is co-planar with said conductor elements, spaced from the shields of said clusters, and is interwoven along with said transversely spaced clusters by said transverse conductive element.

4. Assembly as in claim 3 wherein there are at least two uninsulated conductors, one located at the respective transverse edges of the cable assembly, said two uninsulated conductors being co-planar with said signal conductors.

5. Assembly as in claim 1 wherein said shielded clusters together with said transverse conductive element and said ground conductor are encapsulated in an insulating and protective covering, said covering being bonded to itself in the portions of the spaces between adjacent spaced clusters not occupied by said transverse conductive element.

6. Assembly as in claim 5 wherein the insulating and protective covering is PVC.

7. Assembly as in claim 5 wherein said covering comprises two separate insulating and protective sheets positioned one on each side of the plane defined by said signal conductors, said sheets being bonded together at their transverse edges and between the shielded clusters and ground conductor.

8. Assembly as in claim 1 wherein said transverse conductive element includes at least one elongated conductor element spirally wound along the cable assembly.

9. Assembly as in claim 1 wherein said transverse conductive element includes a screen formed of conductive material.

10. Assembly as in claim 1 wherein said transverse conductive element contacts a given cluster only on one side or the other of the plane defined by said signal conductors along the entire cable length.

11. A flat multiconductor cable assembly of unlimited length comprising:

(a) a plurality of signal conductors positioned in longitudinally parallel and co-planar relation, said signal conductors being electrically insulated from one another and arranged in clusters of one or more, each of said cluster being co-axially surrounded by an electrically conductive shield, the individual shielded clusters being transversely spaced from one another;

(b) at least one uninsulated conductor extending in the longitudinal direction parallel to said shielded clusters for grounding the shields of said clusters, said uninsulated conductor being transversely spaced from said shielded clusters;

(c) a transverse conductive element for electrically interconnecting the shields of said shielded clusters and said uninsulated conductor in the transverse direction, said transverse conductive element bieng interwoven among the transversely spaced shielded and extending intermittently in the longitudinal direction in the spaces between said shielded clusters; and (d) an insulating and protective covering encapsulating said shielded clusters and said uninsulated conductor together with said transverse conductive element, said covering including a pair of sheets positioned one on each side of the plane defined by said shielded clusters and bonded together in the portions of the spaces between adjacent spaced clusters not occupied by said transverse conductive element, whereby said shielded clusters are arbitrarily geometrically arranged on said transverse conductive element.

12. Assembly as in claim 11 wherein said at least one uninsulated conductor comprises two uninsulated conductors, one positioned at each cable transverse edge and together transversely bounding the shielded clusters to be interconnected, wherein said transverse conductive element is spirally wound along the cable assembly between said two uninsulated conductors.

13. Assembly as in claim 11 wherein said transverse conductive element includes a conductive screen strip transversely spanning both the shielded clusters to be interconnected and said uninsulated conductor.

14. Assembly as in claim 11 wherein said transverse conductive element contacts a given one of said shielded clusters only on one side or the other of said plane throughout the entire length of the cable.

15. Method for fabricating a flat multiconductor cable assembly of unlimited length having at least one ground wire conductor wherein a plurality of insulated signal conductors are positioned in longitudinally parallel and transversely co-planar relation with the ground wire conductor, and wherein the signal conductors are arranged in clusters of one or more, and the individual clusters are coaxially surrounded by an electrically conductive shield, the shielded clusters being physically spaced from, but electrically interconnected with, one another and the ground wire conductor in the transverse direction, the method comprising:

(a) dividing sources of the unlimited length individually shielded clusters into two groups positioned proximate a pair of pinch rollers;

(b) continuously feeding the shielded clusters into the bite of the pinch rollers, the shielded clusters from one of said groups being interspersed with the shielded clusters from the other of said two groups across the transverse width of the bite, and the shielded clusters from one group being fed from one side of a plane passing through the bite of the pinch rollers and the shielded clusters from the other group being fed from the other side of the plane;

(c) concurrently feeding at least one continuous uninsulated grund wire conductor of unlimited length into the bite of the pinch rollers parallel with, and transversely spaced from, said clusters; and (d) concurrently feeding an uninsulated transverse conductive element of unlimited longitudinal length into the bite of the rollers along said plane and between the shielded clusters being fed from the two source groups, the transverse conductive element transversely spanning and electrically interconnecting the shields of the clusters and the uninsulated ground wire conductor, the transverse conductor having sufficient flexibility in the transverse direction to conform to a serpentine transverse conductor element path shape wherein the transverse conductive element passes alternately to one side, between, and to the other side of the interspersed clusters with respect to said plane, said transverse conductor extending intermittently in the spaces between interspersed clusters along the entire longitudinal length of the cable assembly.

16. Method as in claim 15 including the additional step of encapsulating the shielded clusters, ground wire conductor, and interwoven transverse conductor element in an insulating and protective covering, the encapsulating step including the step of bonding the cover to itself through the portions of the spaces between adjacent clusters not occupied by the transverse conductor element.

17. Method as in claim 15 wherein the pair of pinch rollers are pre-grooved for transversely spacing the shielded clusters and ground wire conductors from one another.

18. Method as in claim 15 wherein shielded clusters are fed to the bite alternately from one group and then the other across the transverse width of the bite.

19. Method as in claim 18 wherein the transverse conductive element is an elongated conductive screen.

20. Method as in claim 15 wherein step (c) includes the steps of feeding at least two uninsulated ground wire conductors into the bite of the pinch rollers, each of said uninsulated ground wire conductors being positioned outside of and spaced from the outermost cluster on the respective transverse edges of the cable assembly, and wherein step (d) includes the substep of preforming the transverse conductor element in the form of a web by continuously spirally wrapping at least one uninsulated elongated conductor between said two uninsulated ground wire conductors prior to feeding the two uninsulated ground wire conductors and the between-suspended web to the bite of the pinch rollers.

* * * * *